US010888753B2

(12) United States Patent
Greaney et al.

(10) Patent No.: US 10,888,753 B2
(45) **Date of Patent: *Jan. 12, 2021**

(54) HIGH LOFT, LOW CENTER-OF-GRAVITY GOLF CLUB HEADS

(71) Applicant: Taylor Made Golf Company, Inc., Carlsbad, CA (US)

(72) Inventors: Mark Vincent Greaney, Vista, CA (US); Brandon H. Woolley, Vista, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/803,635

(22) Filed: Feb. 27, 2020

(65) Prior Publication Data

US 2020/0188750 A1 Jun. 18, 2020

Related U.S. Application Data

(63) Continuation of application No. 16/192,311, filed on Nov. 15, 2018, now Pat. No. 10,596,432, which is a continuation of application No. 15/830,920, filed on Dec. 4, 2017, now Pat. No. 10,143,903, which is a continuation of application No. 15/146,581, filed on May 4, 2016, now Pat. No. 9,844,708, which is a continuation of application No. 13/339,933, filed on Dec. 29, 2011, now Pat. No. 9,358,430.

(Continued)

(51) Int. Cl.
*A63B 60/00* (2015.01)
*A63B 53/04* (2015.01)

(52) U.S. Cl.
CPC ..... *A63B 60/00* (2015.10); *A63B 53/04* (2013.01); *A63B 53/0466* (2013.01); *A63B 53/0433* (2020.08); *A63B 53/0437* (2020.08); *A63B 2209/02* (2013.01)

(58) Field of Classification Search
CPC ..... A63B 60/00; A63B 53/0466; A63B 53/04; A63B 2209/02; A63B 2053/0433; A63B 2053/0437
USPC ..... 473/324–350, 287–292
See application file for complete search history.

(56) References Cited

U.S. PATENT DOCUMENTS 4,021,047 A 5/1977 Mader
4,432,549 A 2/1984 Zebelean
(Continued)

FOREIGN PATENT DOCUMENTS

JP H06190088 7/1994
JP H10263118 10/1998
(Continued)

OTHER PUBLICATIONS

"Cleveland HiBore Driver Review," http:thesandtrip.com, 7 pages, May 19, 2006.

(Continued)

*Primary Examiner* — Sebastiano Passaniti
(74) *Attorney, Agent, or Firm* — Klarquist Sparkman, LLP

(57) ABSTRACT

A golf club and golf club head having a high static loft angle, low forward center of gravity, and enhanced z-axis gear effect via a large roll radius and/or tightly controlled moment of inertia about the CG x-axis, Ixx, associated with upward and downward twisting of the club head.

20 Claims, 11 Drawing Sheets

Related U.S. Application Data

(60) Provisional application No. 61/429,013, filed on Dec. 31, 2010.

(56) References Cited

U.S. PATENT DOCUMENTS

| | | | |
|---|---|---|---|
| 4,694,093 | A | 9/1987 | Sugimori |
| 5,000,454 | A | 3/1991 | Soda |
| 5,143,987 | A | 9/1992 | Hansel |
| 5,301,941 | A | 4/1994 | Allen |
| 5,377,986 | A | 1/1995 | Viollaz et al. |
| 5,429,357 | A | 7/1995 | Kobayashi |
| 5,797,807 | A | 8/1998 | Moore |
| RE35,931 | E | 10/1998 | Schroder et al. |
| 5,851,160 | A | 12/1998 | Rugge et al. |
| 5,935,020 | A | 8/1999 | Stites et al. |
| 6,086,485 | A | 7/2000 | Hamada et al. |
| 6,139,445 | A | 10/2000 | Werner et al. |
| 6,340,337 | B2 | 1/2002 | Hasebe |
| 6,344,002 | B1 | 2/2002 | Kajita |
| 6,572,491 | B2 | 6/2003 | Hasebe et al. |
| 6,776,723 | B2 | 8/2004 | Bliss et al. |
| 6,939,247 | B1 | 9/2005 | Schweigert et al. |
| 7,025,695 | B2 | 4/2006 | Mitsuba |
| 7,166,038 | B2 | 1/2007 | Williams et al. |
| 7,229,362 | B2 | 6/2007 | Tavares |
| 7,267,620 | B2 | 9/2007 | Chao et al. |
| 7,628,713 | B2 | 12/2009 | Tavares |
| 7,674,187 | B2 | 3/2010 | Cackett et al. |
| 7,674,189 | B2 | 3/2010 | Beach et al. |
| 7,731,603 | B2 | 6/2010 | Beach et al. |
| 7,771,291 | B1 | 8/2010 | Willett et al. |
| 7,927,229 | B2 | 4/2011 | Jertson et al. |
| 8,012,038 | B1 | 9/2011 | Beach et al. |
| 8,012,039 | B2 | 9/2011 | Greaney et al. |
| 8,088,025 | B2 | 1/2012 | Wahl |
| 8,133,135 | B2 | 3/2012 | Stites et al. |
| 8,187,115 | B2 | 5/2012 | Bennett et al. |
| D686,679 | S | 7/2013 | Greensmith et al. |
| 8,496,544 | B2 | 7/2013 | Curtis et al. |
| 8,523,705 | B2 | 9/2013 | Breier et al. |
| 8,529,368 | B2 | 9/2013 | Rice et al. |
| D692,077 | S | 10/2013 | Greensmith et al. |
| D696,366 | S | 12/2013 | Milo et al. |
| D696,367 | S | 12/2013 | Taylor et al. |
| D697,152 | S | 1/2014 | Harbert et al. |
| 8,647,217 | B2 | 2/2014 | Nishio |
| 8,663,029 | B2 | 3/2014 | Beach et al. |
| 8,827,831 | B2 | 9/2014 | Burnett et al. |
| 8,858,360 | B2 | 10/2014 | Rice et al. |
| 9,033,813 | B2 | 5/2015 | Oldknow |
| 9,044,653 | B2 | 6/2015 | Wahl et al. |
| 9,220,953 | B2 | 12/2015 | Beach et al. |
| 9,320,948 | B2 | 4/2016 | Fossum |
| 9,345,938 | B2 | 5/2016 | Parsons |
| 9,358,430 | B2 | 6/2016 | Greaney et al. |
| 9,844,708 | B2 | 12/2017 | Greaney et al. |
| 10,143,903 | B2 | 12/2018 | Greaney et al. |
| 10,596,432 | B2 * | 3/2020 | Greaney ..... A63B 53/04 |
| 2002/0006836 | A1 | 1/2002 | Helmstetter et al. |
| 2002/0183134 | A1 | 12/2002 | Allen et al. |
| 2003/0114239 | A1 | 6/2003 | Mase |
| 2003/0134690 | A1 | 7/2003 | Chen |
| 2004/0157678 | A1 | 8/2004 | Kohno |
| 2004/0162156 | A1 | 8/2004 | Kohno |
| 2005/0059508 | A1 | 3/2005 | Burnett et al. |
| 2005/0159243 | A1 | 7/2005 | Chuang |
| 2006/0019770 | A1 | 1/2006 | Meyer et al. |
| 2006/0116218 | A1 | 6/2006 | Burnett et al. |
| 2008/0146374 | A1 | 6/2008 | Beach et al. |
| 2009/0124411 | A1 | 5/2009 | Rae et al. |
| 2009/0137338 | A1 | 5/2009 | Kajita |
| 2009/0149275 | A1 | 6/2009 | Rae et al. |
| 2009/0170632 | A1 | 7/2009 | Beach et al. |
| 2009/0191980 | A1 | 7/2009 | Greaney et al. |
| 2009/0293259 | A1 | 12/2009 | Rice |
| 2010/0187710 | A1 | 7/2010 | Tanaka et al. |
| 2011/0014992 | A1 | 1/2011 | Morrissey |
| 2013/0102408 | A1 | 4/2013 | Shear |
| 2014/0080634 | A1 | 3/2014 | Golden et al. |
| 2014/0256461 | A1 | 9/2014 | Beach et al. |
| 2014/0256464 | A1 | 9/2014 | Chao et al. |
| 2014/0274457 | A1 | 9/2014 | Beach et al. |
| 2016/0101328 | A1 | 4/2016 | Luttrell et al. |
| 2016/0243414 | A1 | 8/2016 | Greaney et al. |
| 2018/0021639 | A1 | 1/2018 | Rice et al. |
| 2018/0154225 | A1 | 6/2018 | Frame et al. |

FOREIGN PATENT DOCUMENTS

| | | |
|---|---|---|
| JP | H11114102 | 4/1999 |
| JP | H11155982 | 6/1999 |
| JP | 2002-052099 | 2/2002 |
| JP | 2002-136625 | 5/2002 |
| JP | 2003-135632 | 5/2003 |
| JP | 2003-210621 | 7/2003 |
| JP | 2003-524487 | 8/2003 |
| JP | 2003-320061 | 11/2003 |
| JP | 2004-174224 | 6/2004 |
| JP | 2004-232397 | 8/2004 |
| JP | 2004-261451 | 9/2004 |
| JP | 2004-265992 | 9/2004 |
| JP | 2004-271516 | 9/2004 |
| JP | 2004-313762 | 11/2004 |
| JP | 2004-351054 | 12/2004 |
| JP | 2004-351173 | 12/2004 |
| JP | 2005-073736 | 3/2005 |
| JP | 2005-111172 | 4/2005 |
| JP | 2005-137494 | 6/2005 |
| JP | 2005-137788 | 6/2005 |
| WO | WO 2005/009543 A2 | 2/2005 |

OTHER PUBLICATIONS

"Invalidity Search Report for Japanese Registered Patent No. 4128970," 4 pp. (Nov. 29, 2013).

* cited by examiner

HIGH LOFT, LOW CENTER-OF-GRAVITY GOLF CLUB HEADS

CROSS-REFERENCE TO RELATED APPLICATIONS

This application is a continuation of U.S. patent application Ser. No. 16/192,311, filed Nov. 15, 2018, which is a continuation of U.S. patent application Ser. No. 15/830,920, filed Dec. 4, 2017, now U.S. Pat. No. 10,143,903, issued Dec. 4, 2018, which is a continuation U.S. patent application Ser. No. 15/146,581, filed May 4, 2016, now U.S. Pat. No. 9,844,708, issued Dec. 19, 2017, which is a continuation of U.S. patent application Ser. No. 13/339,933, filed Dec. 29, 2011, now U.S. Pat. No. 9,358,430, issued Jun. 7, 2016, which claims the benefit of U.S. Provisional Patent Application No. 61/429,013, filed Dec. 31, 2010, all of which are herein incorporated by reference in their entirety.

FIELD

The present application concerns golf club heads, and more particularly, golf club heads having high static loft angles, low centers of gravity, or both high static loft angles and low centers of gravity.

BACKGROUND

The center of gravity (CG) of a golf club head is a critical parameter of the club's performance. Upon impact, the position of the CG greatly affects launch angle and flight trajectory of a struck golf ball. Thus, much effort has been made over positioning the center of gravity of golf club heads. To that end, current driver and fairway wood golf club heads are typically formed of lightweight, yet durable material, such as steel or titanium alloys. These materials are typically used to form thin club head walls. Thinner walls are lighter, and thus result in greater discretionary weight, i.e., weight available for redistribution around a golf club head. Greater discretionary weight allows golf club manufacturers more leeway in assigning club mass to achieve desired golf club head mass distributions.

Golf swings vary among golfers. The mass properties (e.g., CG location, moment of inertia, etc.) and design geometry (e.g., static loft) of a given golf club may provide a high level of performance for a golfer having a relatively high swing speed, but not for a golfer having a relatively slower swing speed.

It should, therefore, be appreciated that there is a need for golf club heads and golf clubs having designs that perform over a wide range of club head swing speeds. The present application fulfills this need and others.

SUMMARY

The following describes golf club heads that include a body defining an interior cavity, a sole portion positioned at a bottom portion of the golf club head, a crown portion positioned at a top portion, and a skirt portion positioned around a periphery between the sole and crown. The golf club head body has a forward portion and a rearward portion, with a striking face positioned at the forward portion of the body.

In a first aspect, embodiments of the golf club head include a face having a static loft angle greater than or equal to 11 degrees. In some instances, the golf club head has a center of gravity that is 7 mm or more below the geometric center of the face of the golf club head as measured along a z-axis of the golf club head having an origin at the geometric center.

In a second aspect, embodiments of the golf club head include a ball striking face of the club head body having a geometric center, and a center of gravity whose projection onto the ball striking face of the club head body is located off-center from the geometric center in a direction toward the sole.

In some instances of the embodiments of the golf club heads of the second aspect, the club head body has a center of gravity that is between 7 mm and 40 mm below the geometric center of the ball striking face of the club head body as measured along the z-axis of the golf club head. In some other instances, the club head body has a static loft angle of between 11 degrees and 33 degrees.

The foregoing and other features and advantages of the golf club head will become more apparent from the following detailed description, which proceeds with reference to the accompanying figures.

DETAILED DESCRIPTION

I. General Considerations

The following disclosure describes embodiments of golf club heads for wood-type clubs (e.g., drivers) that incorporate higher loft angles, lower centers of gravity, or both higher loft angles and lower centers of gravity relative to conventional wood-type clubs. The disclosed embodiments should not be construed as limiting in any way. Instead, the present disclosure is directed toward all novel and nonobvious features and aspects of the various disclosed embodiments, alone and in various combinations and subcombinations with one another. Furthermore, any features or aspects of the disclosed embodiments can be used in various combinations and subcombinations with one another. The disclosed embodiments are not limited to any specific aspect or feature or combination thereof, nor do the disclosed embodiments require that any one or more specific advantages be present or problems be solved.

The present disclosure makes reference to the accompanying drawings which form a part hereof, wherein like numerals designate like parts throughout. The drawings illustrate specific embodiments, but other embodiments may be formed and structural changes may be made without departing from the intended scope of this disclosure. Directions and references may be used to facilitate discussion of the drawings but are not intended to be limiting. For example, certain terms may be used such as "up," "down," "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. Accordingly, the following detailed description shall not to be construed in a limiting sense.

A. Normal Address Position

Figure 1:
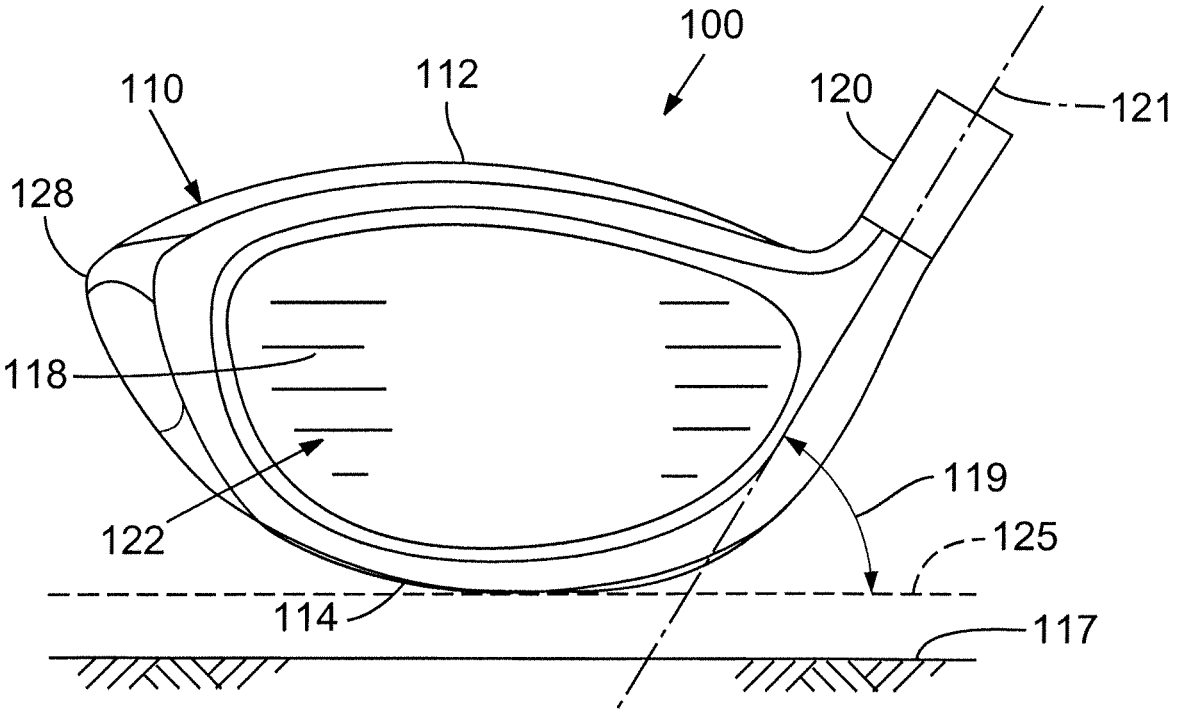
FIG. 1 is a front elevation view of an exemplary embodiment of a golf club head.
Figure 2:
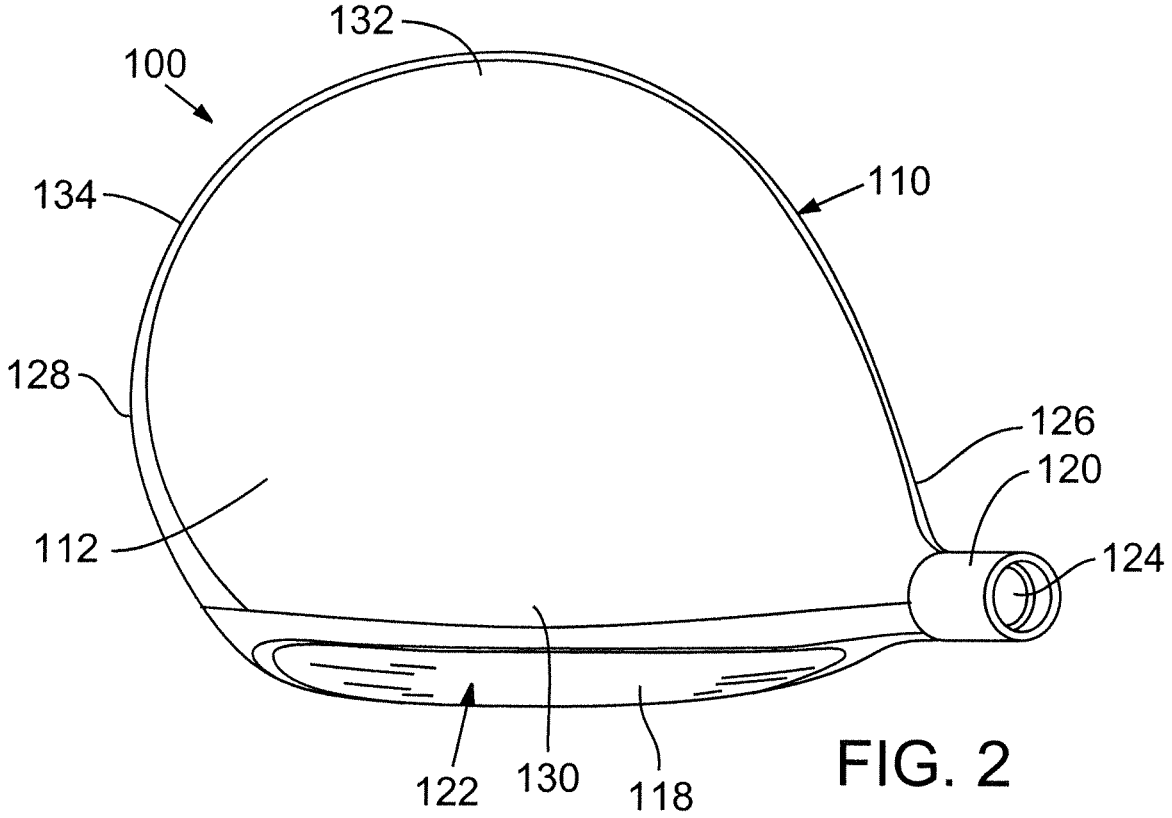
FIG. 2 is a top plan view of the golf club head of FIG. 1.
Figure 3:
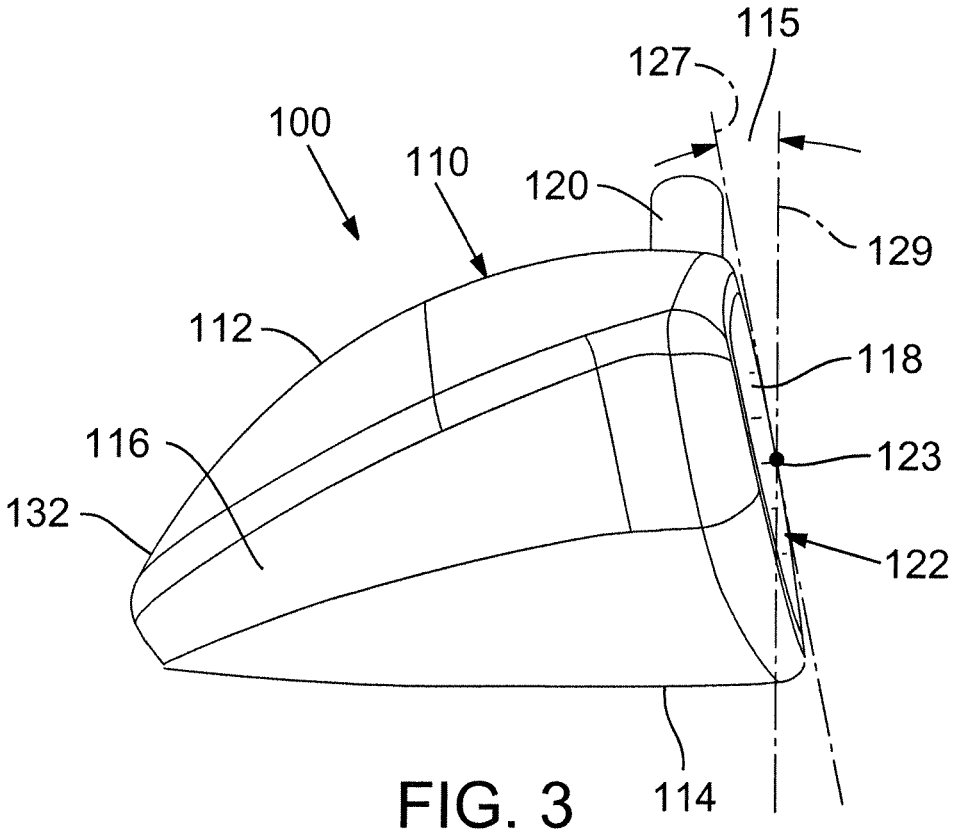
FIG. 3 is a side elevation view from a toe side of the golf club head of FIG. 1.

Club heads and many of their physical characteristics disclosed herein will be described using "normal address position" as the club head reference position, unless otherwise indicated. FIGS. 1-3 illustrate one embodiment of a driving-wood-type golf club head at normal address position. FIG. 1 illustrates a front elevation view of golf club head 100, FIG. 2 illustrates a top plan view of the golf club head 100, and FIG. 3 illustrates a side elevation view of the golf club head 100 from the toe side. By way of preliminary description, the club head 100 includes a hosel 120 and a ball striking club face 118. At normal address position, the club head 100 is positioned on a plane 125 above and parallel to a ground plane 117.

As used herein, "normal address position" means the club head position wherein a vector normal to the club face 118 substantially lies in a first vertical plane (a vertical plane is perpendicular to the ground plane 117), the centerline axis 121 of the club shaft substantially lies in a second substantially vertical plane, and the first vertical plane and the second substantially vertical plane substantially perpendicularly intersect.

B. Club Head Features

A driving-wood-type golf club head, such as the golf club head 100 shown in FIGS. 1-3, includes a hollow body 110 defining a crown portion 112, a sole portion 114, a skirt portion 116, and a ball striking club face 118. The ball striking club face 118 can be integrally formed with the body 110 or attached to the body. The body 110 further includes a hosel 120, which defines a hosel bore 124 adapted to receive a golf club shaft. The body 110 further includes a heel portion 126, a toe portion 128, a front portion 130, and a rear portion 132.

The club head 100 also has a volume, typically measured in cubic-centimeters ($cm^3$), equal to the volumetric displacement of the club head, assuming any apertures are sealed by a substantially planar surface.

As used herein, "crown" means an upper portion of the club head above a peripheral outline 134 of the club head as viewed from a top-down direction and rearward of the topmost portion of a ball striking surface 122 of the ball striking club face 118. As used herein, "sole" means a lower portion of the club head 100 extending upwards from a lowest point of the club head when the club head is at the normal address position. In some implementations, the sole 114 extends approximately 50% to 60% of the distance from the lowest point of the club head to the crown 112. In other implementations, the sole 114 extends upwardly from the lowest point of the golf club head 110 a shorter distance. Further, the sole 114 can define a substantially flat portion extending substantially horizontally relative to the ground 117 when in normal address position or can have an arced or convex shape as shown in FIG. 1. As used herein, "skirt" means a side portion of the club head 100 between the crown 112 and the sole 114 that extends across a periphery 134 of the club head, excluding the striking surface 122, from the toe portion 128, around the rear portion 132, to the heel portion 126. As used herein, "striking surface" means a front or external surface of the ball striking club face 118 configured to impact a golf ball. In some embodiments, the striking surface 122 can be a striking plate attached to the body 110 using known attachment techniques, such as welding. Further, the striking surface 122 can have a variable thickness. In certain embodiments, the striking surface 122 has a bulge and roll curvature (discussed more fully below).

The body 110, or any parts thereof, can be made from a metal alloy (e.g., an alloy of titanium, an alloy of steel, an alloy of aluminum, and/or an alloy of magnesium), a composite material (e.g., a graphite or carbon fiber composite) a ceramic material, or any combination thereof. The crown 112, sole 114, skirt 116, and ball striking club face 118 can be integrally formed using techniques such as molding, cold forming, casting, and/or forging. Alternatively, any one or more of the crown 112, sole 114, skirt 116, or ball striking club face 118 can be attached to the other components by known means (e.g., adhesive bonding, welding, and the like).

In some embodiments, the striking face 118 is made of a composite material, while in other embodiments, the striking face 118 is made from a metal alloy (e.g., an alloy of titanium, steel, aluminum, and/or magnesium), ceramic material, or a combination of composite, metal alloy, and/or ceramic materials.

When at normal address position, the club head 100 is disposed at a lie angle 119 relative to the club shaft axis 121 (as shown in FIG. 1) and the club face has a loft angle 115 (as shown in FIG. 2). Referring to FIG. 1, the lie angle 119 refers to the angle between the centerline axis 121 of the club shaft and the ground plane 117 at normal address position. Referring to FIG. 3, loft angle 115 refers to the angle between a tangent line 127 to the club face 118 and a vector 129 normal to the ground plane at normal address position.

Figure 4:
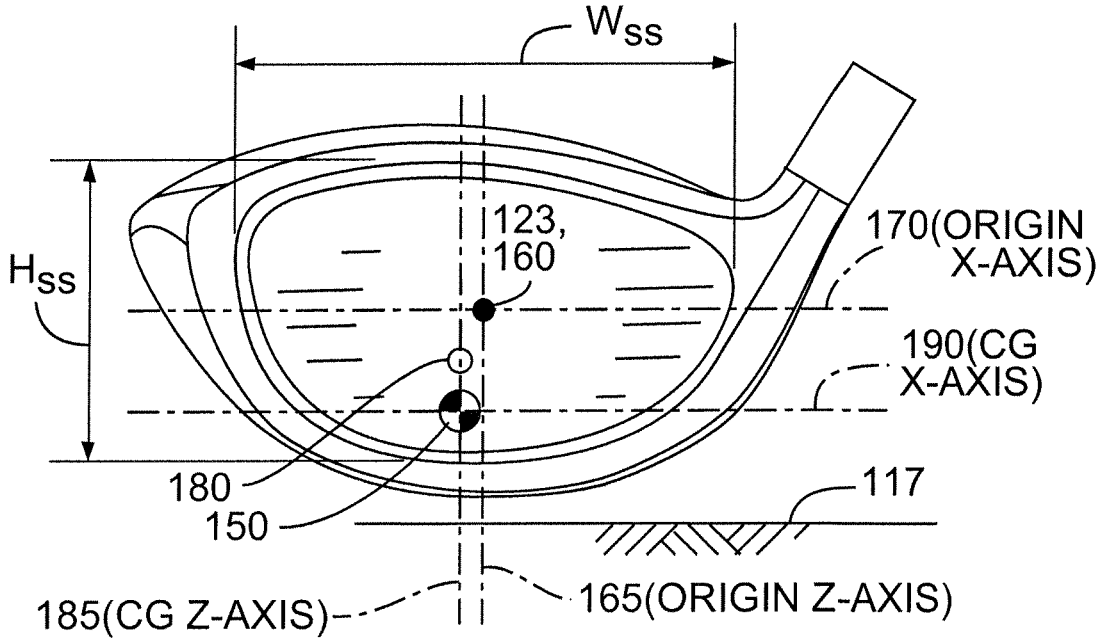
FIG. 4 is a front elevation view of the golf club of FIG. 1 illustrating club head origin and center of gravity origin coordinate systems.
Figure 5:
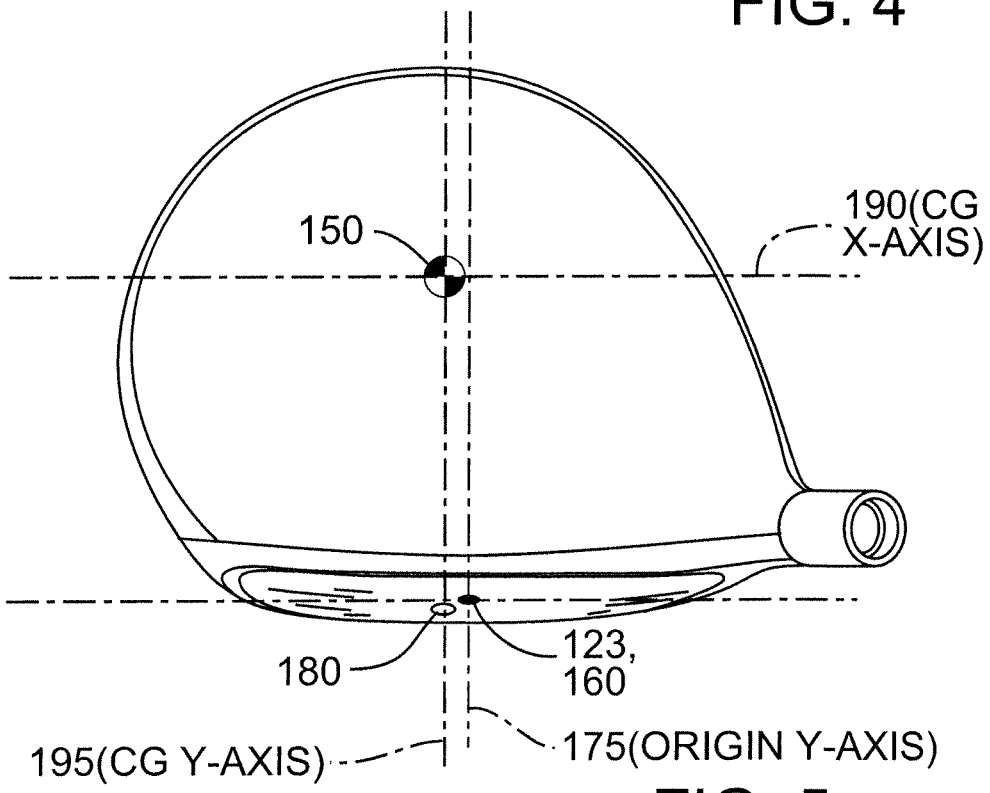
FIG. 5 is a top plan view of the golf club of FIG. 1 illustrating the club head origin and center of gravity origin coordinate systems.
Figure 6:
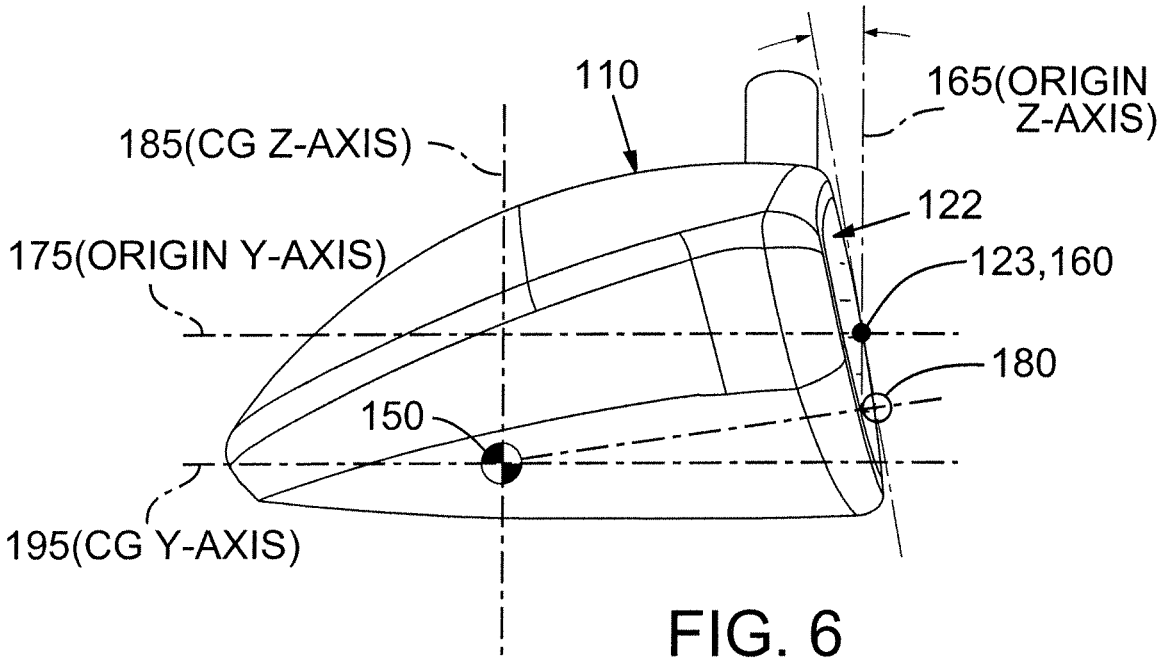
FIG. 6 is a side elevation view from a toe side of the golf club of FIG. 1 illustrating the club head origin and center of gravity origin coordinate systems.

FIGS. 4-6 illustrate coordinate systems that can be used in describing features of the disclosed golf club head embodiments. FIG. 4 illustrates a front elevation view of the golf club head 100, FIG. 5 illustrates a top plan view of the golf club head 100, and FIG. 3 illustrates a side elevation view of the golf club head 100 from the toe side. As shown in FIGS. 4-6, a center 123 is disposed on the striking surface 122. For purposes of this disclosure, the center 123 is defined as the intersection of the midpoints of a height ($H_{ss}$) and a width ($W_{ss}$) of the striking surface 122. Both $H_{ss}$ and $W_{ss}$ are determined using the striking face curve ($S_{ss}$). The striking face curve is bounded on its periphery by all points where the face transitions from a substantially uniform bulge radius (face heel-to-toe radius of curvature) and a substantially uniform roll radius (face crown-to-sole radius of curvature) to the body. $H_{ss}$ is the distance from the periphery proximate to the sole portion of $S_{ss}$ (also referred to as the bottom radius of the club face) to the periphery proximate to the crown portion of $S_{ss}$ (also referred to as the top radius of the club face) measured in a vertical plane (perpendicular to ground) that extends through the center 123 of the face (e.g., this plane is substantially normal to the x-axis). Similarly, $W_{ss}$ is the distance from the periphery proximate to the heel portion of $S_{ss}$ to the periphery proximate to the toe portion of $S_{ss}$ measured in a horizontal plane (e.g., substantially parallel to ground) that extends through the center 123 of the face (e.g., this plane is substantially normal to the z-axis). In other words, the center 123 along the z-axis corresponds to a point that bisects into two equal parts a line drawn from a point just on the inside of the top radius of the striking surface (and centered along the x-axis of the striking surface) to a point just on the inside of the bottom radius of the face plate (and centered along the x-axis of the striking surface). For purposes of this disclosure, the center 123 is also be referred to as the "geometric center" of the golf club striking surface 122. See also U.S.G.A. "Procedure for Measuring the Flexibility of a Golf Clubhead," Revision 2.0 for the methodology to measure the geometric center of the striking face.

C. Golf Club Head Coordinates

Referring to FIGS. 4-6, a club head origin coordinate system can be defined such that the location of various features of the club head (including a club head center-of-gravity (CG) 150) can be determined. A club head origin 160 is illustrated on the club head 100 positioned at the center 123 of the striking surface 122.

The head origin coordinate system defined with respect to the head origin 160 includes three axes: a z-axis 165 extending through the head origin 160 in a generally vertical direction relative to the ground 117 when the club head 100 is at the normal address position; an x-axis 170 extending through the head origin 160 in a toe-to-heel direction generally parallel to the striking surface 122 (e.g., generally tangential to the striking surface 122 at the center 123) and generally perpendicular to the z-axis 165; and a y-axis 175 extending through the head origin 160 in a front-to-back direction and generally perpendicular to the x-axis 170 and to the z-axis 165. The x-axis 170 and the y-axis 175 both extend in generally horizontal directions relative to the ground 117 when the club head 100 is at the normal address position. The x-axis 170 extends in a positive direction from the origin 160 towards the heel 126 of the club head 100. The y-axis 175 extends in a positive direction from the head origin 160 towards the rear portion 132 of the club head 100. The z-axis 165 extends in a positive direction from the origin 160 towards the crown 112.

D. Center of Gravity

Generally, the center of gravity (CG) of a golf club head is the average location of the weight of the golf club head or the point at which the entire weight of the golf club head may be considered as concentrated so that if supported at this point the head would remain in equilibrium in any position.

Referring to FIGS. 4-6, a CG 150 is shown as a point inside the body 110 of the club head 100. The location of the club CG 150 can also be defined with reference to the club head origin coordinate system. For example, and using millimeters as the unit of measure, a CG 150 that is located 3.2 mm from the head origin 160 toward the toe of the club head along the x-axis, 36.7 mm from the head origin 160 toward the rear of the club head along the y-axis, and 4.1 mm from the head origin 160 toward the sole of the club head along the z-axis can be defined as having a $CG_x$ of −3.2 mm, a $CG_y$ of −36.7 mm, and a $CG_z$ of −4.1 mm.

The CG can also be used to define a coordinate system with the CG as the origin of the coordinate system. For example, and as illustrated in FIGS. 4-6, the CG origin coordinate system defined with respect to the CG origin 150 includes three axes: a CG z-axis 185 extending through the CG 150 in a generally vertical direction relative to the ground 117 when the club head 100 is at normal address position; a CG x-axis 190 extending through the CG origin 150 in a toe-to-heel direction generally parallel to the striking surface 122 (e.g., generally tangential to the striking surface 122 at the club face center 123), and generally perpendicular to the CG z-axis 185; and a CG y-axis 195 extending through the CG origin 150 in a front-to-back direction and generally perpendicular to the CG x-axis 190 and to the CG z-axis 185. The CG x-axis 190 and the CG y-axis 195 both extend in generally horizontal directions relative to the ground 117 when the club head 100 is at normal address position. The CG x-axis 190 extends in a positive direction from the CG origin 150 to the heel 126 of the club head 100. The CG y-axis 195 extends in a positive direction from the CG origin 150 towards the rear portion 132 of the golf club head 100. The CG z-axis 185 extends in a positive direction from the CG origin 150 towards the crown 112. Thus, the axes of the CG origin coordinate system are parallel to corresponding axes of the head origin coordinate system. In particular, the CG z-axis 185 is parallel to z-axis 165, CG x-axis 190 is parallel to x-axis 170, and CG y-axis 195 is parallel to y-axis 175.

As best shown in FIG. 6, FIGS. 4-6 also show a projected CG point 180 on the golf club head striking surface 122. The projected CG point 180 is the point on the striking surface 122 that intersects with a line that is normal to the tangent line 127 of the ball striking club face 118 and that passes through the CG 150. This projected CG point 180 can also be referred to as the "zero-torque" point because it indicates the point on the ball striking club face 118 that is centered with the CG 150. Thus, if a golf ball makes contact with the club face 118 at the projected CG point 180, the golf club head will not twist about any axis of rotation since no torque is produced by the impact of the golf ball.

II. Exemplary Embodiments of High Loft, Low CG Golf Club Heads

A. Z-Axis Gear Effect

Figure 7:
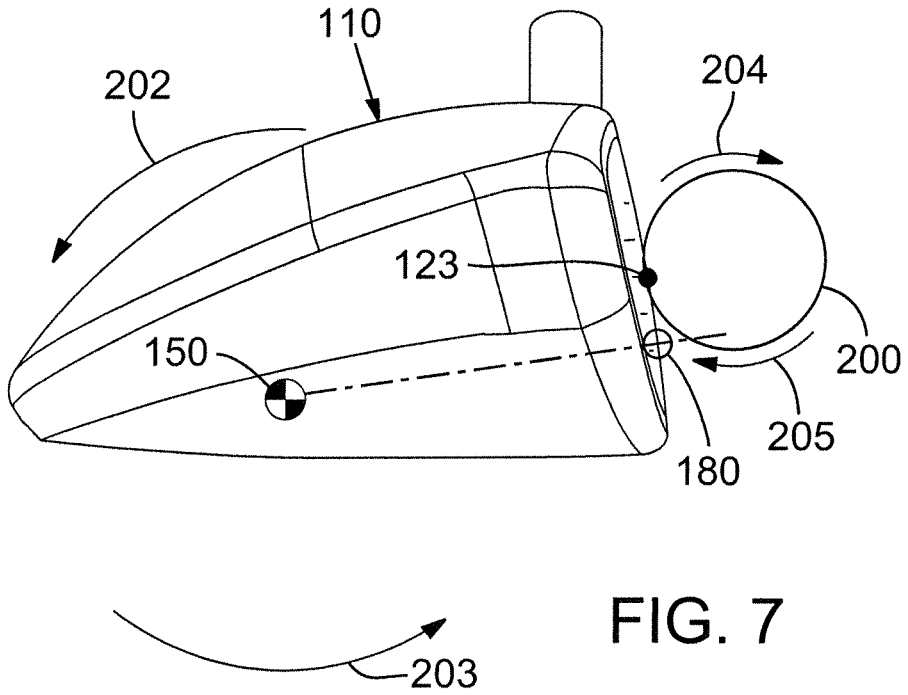
FIG. 7 is a side elevation view from a toe side of the golf club of FIG. 1 illustrating the projection of the center of gravity (CG) onto the golf club head face.

In certain embodiments disclosed herein, the projected CG point on the ball striking club face is located below the geometric center of the club face. In other words, the projected CG point on the ball striking club face is closer to the sole of the club face than the geometric center. As a result, and as illustrated in FIG. 7, when the golf club is swung such that the club head 100 impacts a golf ball 200 at the club head's center 123, the impact is "off center" from the projected CG point 180, creating torque that causes the body of the golf club head to rotate (or twist) about the CG x-axis (which is normal to the page in FIG. 7). This rotation of the golf club head about the x-axis is illustrated in FIG. 7 by arrows 202, 203. The rotation of the club face creates a "z-axis gear effect." More specifically, the rotation of the club head about the CG x-axis tends to induce a component of spin on the ball. In particular, the backward rotation (shown by arrows 202, 203) of the club head face that occurs as the golf ball is compressed against the club face during impact causes the ball to rotate in a direction opposite to the rotation of the club face, much like two gears interfacing with one another. Thus, the backward rotation of the club face during impact creates a component of forward rotation (shown by arrows 204, 205) in the golf ball. This effect is termed the "z-axis gear effect." Because the loft of a golf club head also creates a significant amount of backspin in a ball impacted by the golf club head, the forward rotation resulting from the z-axis gear effect is typically not enough to completely eliminate the backspin of the golf ball, but instead reduces the backspin from that which would normally be experienced by the golf ball. In general, the forward rotation (or topspin) component resulting from the z-axis gear effect is increased as the impact point of a golf ball moves upward from (or higher above) the projected CG point on the ball striking club face. Additionally, the effective loft of the golf club head that is experienced by the golf ball and that determines the launch conditions of the golf ball can be different than the static loft of the golf club head. The difference between the golf club head's effective loft at impact and its static loft angle at address is referred to as "dynamic loft" and can result from a number of factors. In general, however, the effective loft of a golf club head is increased from the static loft as the impact point of a golf ball moves upward from (or higher than) the projected CG point on the ball striking club face.

Figure 8:
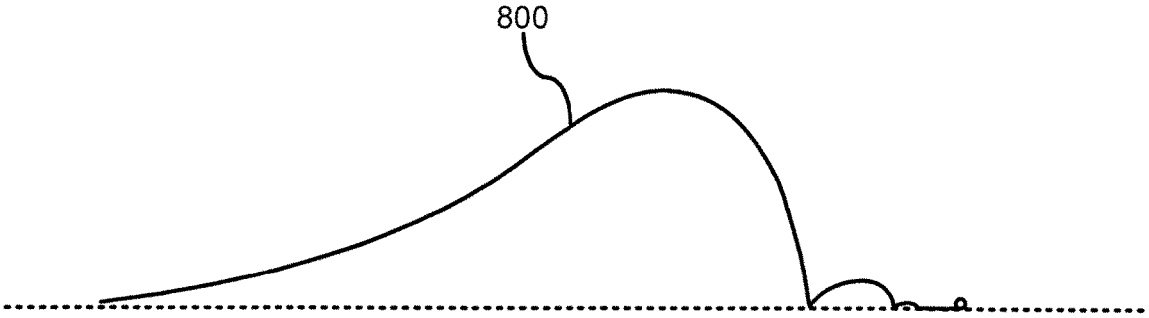
FIG. 8 is a schematic elevation view of the trajectory of a golf ball hit with a driver having a $CG_z$ aligned with the geometric center of the ball striking club face.

FIG. 8 is a schematic side view 800 illustrating trajectory 800 of a golf ball hit by a driver having a projected CG that coincides with the geometric center of the striking surface. The launch conditions created from such a driver typically include a low launch angle and a significant amount of backspin. The backspin on the ball causes it to quickly rise in altitude and obtain a more vertical trajectory, "ballooning" into the sky. Consequently, the ball tends to quickly lose its forward momentum as it is transferred to vertical momentum, eventually resulting in a steep downward trajectory that does not create a significant amount of roll. As illustrated by FIG. 8, then, even though some backspin can be beneficial to a golf ball's trajectory by allowing it to "rise" vertically and resist a parabolic trajectory, too much backspin can cause the golf ball to lose distance by transferring too much of its forward momentum into vertical momentum.

Figure 9:
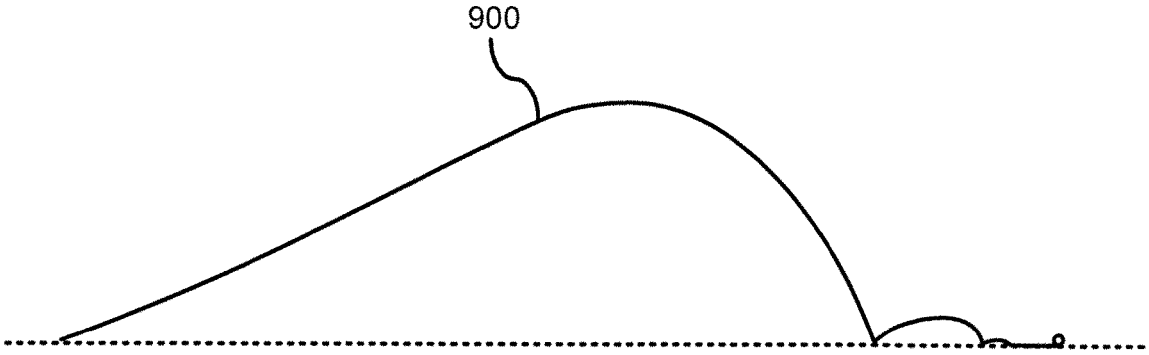
FIG. 9 is a schematic elevation view of the trajectory of a golf ball hit with a driver having a $CG_z$ lower than the geometric center of the ball striking club face.

FIG. 9, by contrast, is a schematic side view illustrating trajectory 900 of a golf ball hit by a driver having a lower center of gravity in accordance with embodiments of the disclosed technology. In FIG. 9, the static loft of the golf club head is assumed to be the same as the driver in FIG. 8, although the static loft can be higher, as more fully explained below. The launch conditions created from a driver having a lower center of gravity includes a higher launch angle and less backspin relative to the driver having a projected CG that coincides with the geometric center of the striking surface. As can be seen in FIG. 9, the trajectory 900 includes less "ballooning" than the trajectory 800 but still has enough backspin for the ball to have some rise and to generally maintain its launch trajectory longer than a ball with no backspin. As a result, the golf ball with trajectory 900 carries further than golf ball with trajectory 800. Furthermore, because the horizontal momentum of the golf ball is greater with trajectory 900 than with trajectory 800, the roll experienced by the golf ball with trajectory 900 is greater than with trajectory 800.

B. Exemplary $CG_z$ and Static Loft Values

In some embodiments described herein, a golf club head for a driver has a higher static loft, a lower center of gravity, or both a higher static loft and a lower center of gravity than conventional drivers. For example, for golf club heads having lower centers of gravity (e.g., centers of gravity that result in a projected CG on the striking surface of the club face below the geometric center of the club face), the backspin of a golf ball struck by the golf club head can be reduced, thereby allowing the golf ball to travel a greater distance (e.g., according to a trajectory similar to the trajectory shown in FIG. 9). Further, for golf club heads having both a higher static loft and a lower center of gravity than conventional drivers, the backspin produced may not be less than a conventional driver (since the higher static loft significantly contributes to increased backspin), but the reduction in backspin produced by the lower CG helps the golf club head reduce the backspin from that which would otherwise be experienced. As a result, greater distance can be obtained from the golf club head. Moreover, for some players, a golf club head having a higher static loft and a lower center of gravity than conventional drivers can produce greater overall driving distances.

Figure 12:
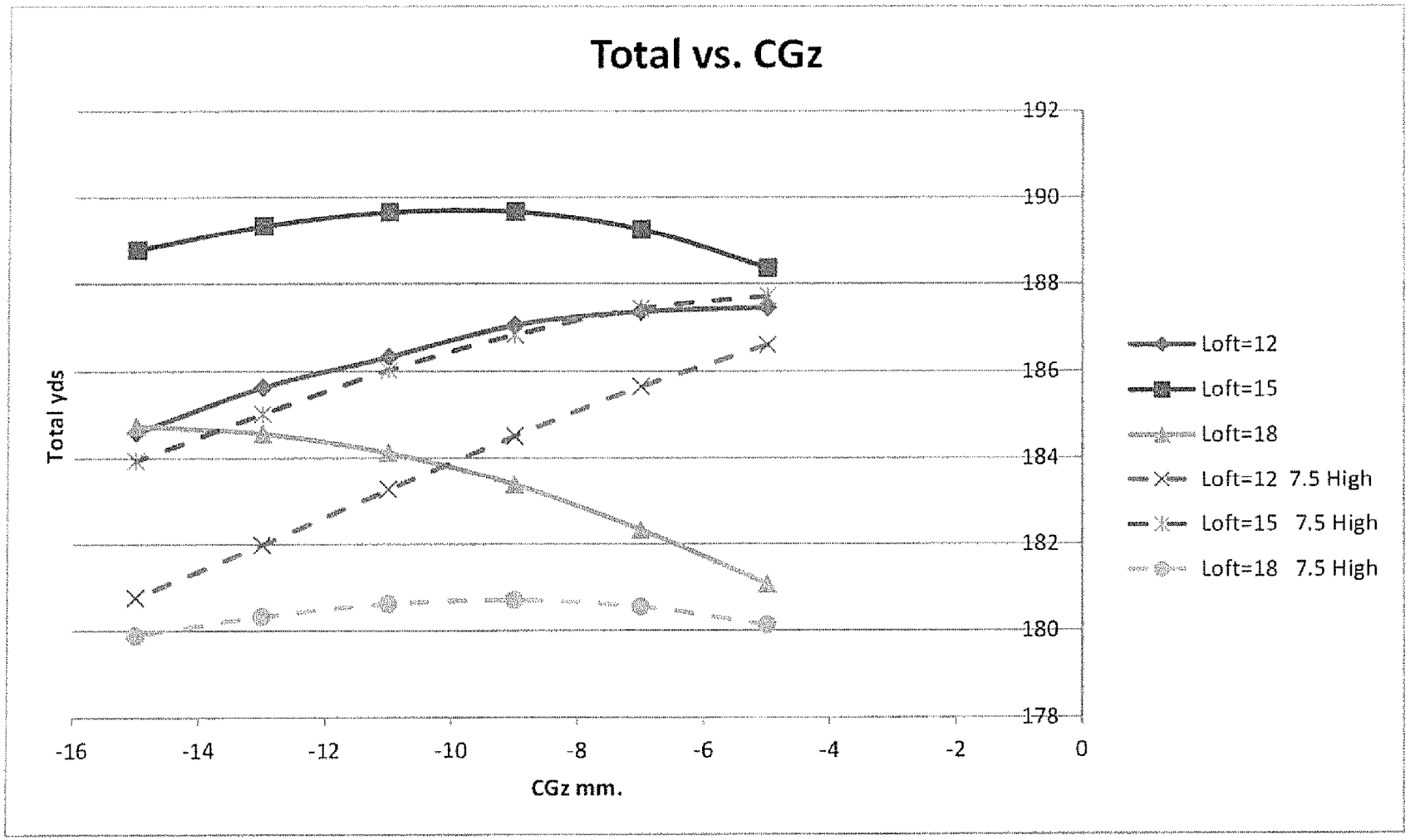
FIG. 12 is a graph showing the total yardage values and $CG_z$ values for simulated golf shots taken by exemplary embodiments of the disclosed technology.
Figure 13:
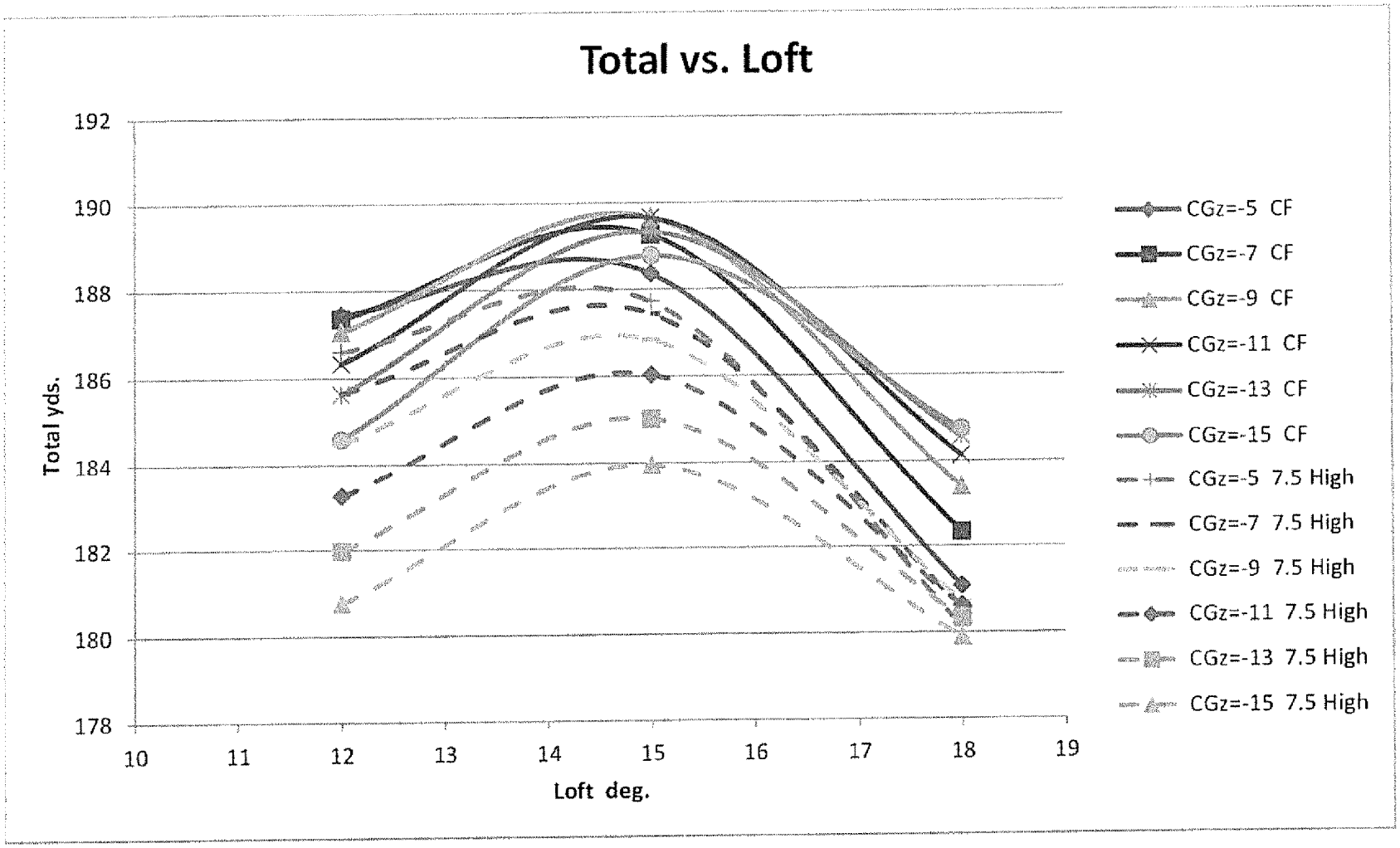
FIG. 13 is a graph showing the total yardage values and loft values for simulated golf shots taken by exemplary embodiments of the disclosed technology.

For example, certain players having swings with slower head speeds (e.g., less than 100 or 90 mph) achieve greater driving distances from a golf club head with a high static loft and low center of gravity. For instance, simulation results indicate that for a club head speed of 80 mph (typical of many amateur golfers), the distance obtained from embodiments of the disclosed golf club heads having a $CG_z$ of −15 mm or less and a static loft of 18° is substantially the same or greater than the distance obtained from a driver having a $CG_z$ of −5 mm and a static loft of 12°. Additional simulation results are shown in the graphs presented in FIGS. 12 and 13, which show total distance (carry plus roll) for golf shots struck at a club head speed of 80 mph. FIG. 12 shows total distance versus CGz location for golf clubs having lofts of 12°, 15°, and 18°, and also showing shots struck at centerface relative to shots struck at 7.5 mm above centerface. FIG. 13 shows total distance versus static loft for golf clubs having CGz locations ranging from −5 mm to −15 mm, also showing shots struck at centerface relative to shots struck at 7.5 mm above centerface.

From the information shown in FIG. 12, the golf club having a 15° static loft provides higher values for total distance over the reported range of CGz values relative to golf clubs having either higher loft (18°) or lower loft (12°). Moreover, from the information shown in FIG. 13, the optimum static loft value for obtaining maximum distance over the reported range of CGz values is between about 14° and about 15°.

Additionally, players sometimes have a preference for clubs having higher static lofts. For instance, many players hit higher lofted clubs more consistently than lower lofted clubs. Thus, many players will benefit from having a driver with a higher loft and a lower center of gravity, even if the overall distance from such a club may be slightly less than the conventional driver.

Figure 10:
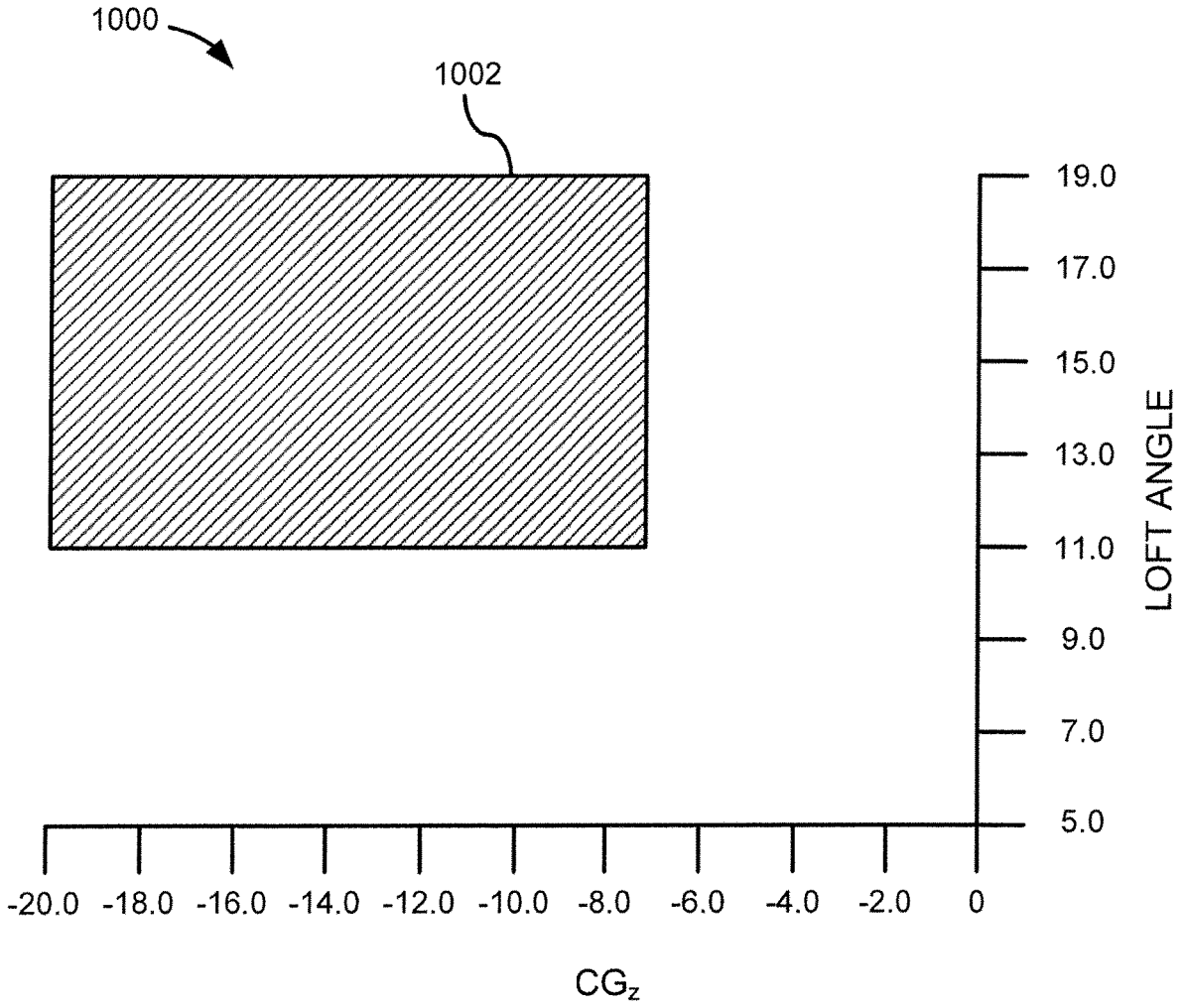
FIG. 10 is a first graph showing static loft and $CG_z$ values for exemplary embodiments of the disclosed technology.
Figure 11:
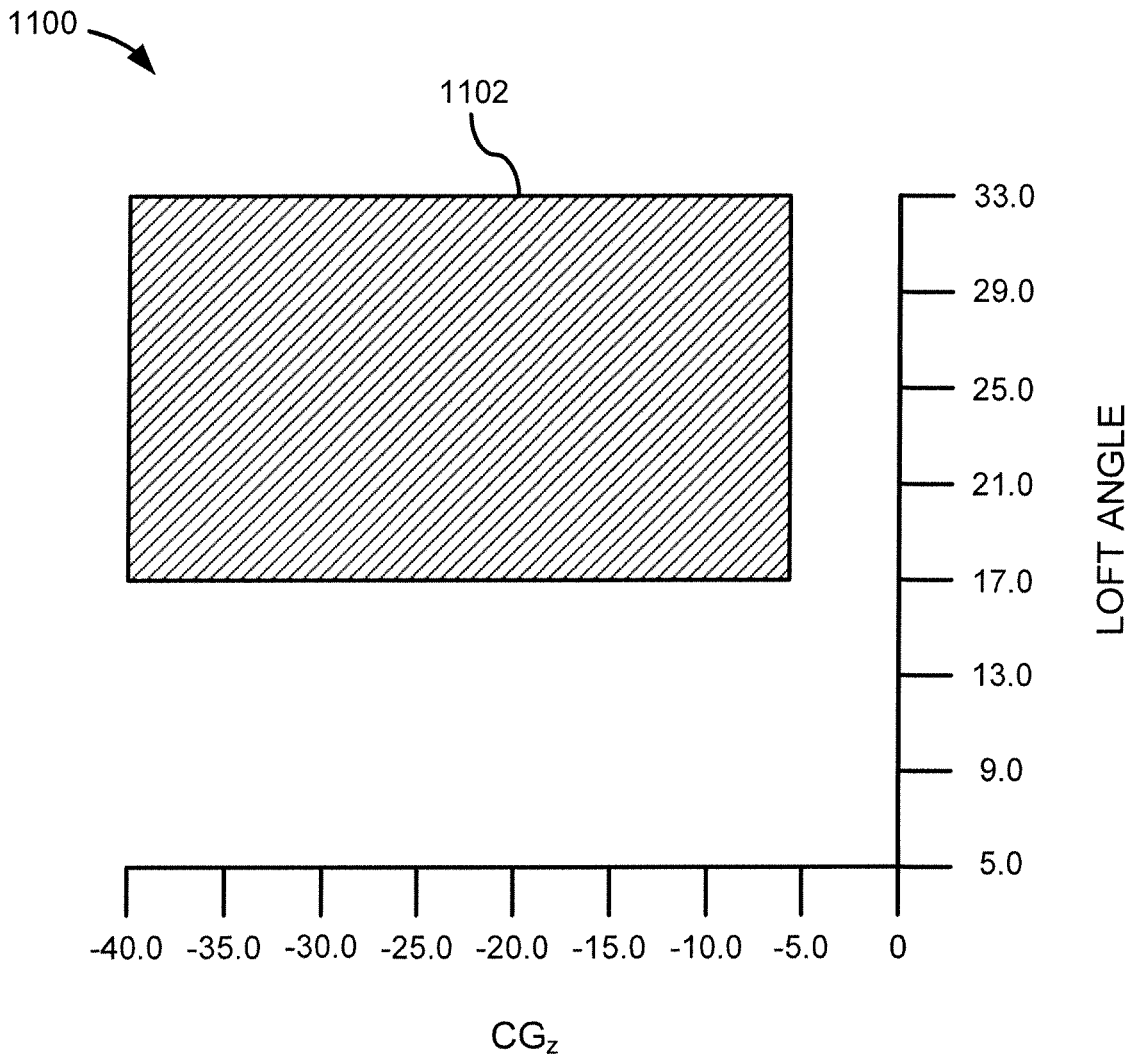
FIG. 11 is a second graph showing static loft and $CG_z$ values for exemplary embodiments of the disclosed technology.

FIGS. 10 and 11 are graphs 1000 and 1100 showing exemplary values of $CG_z$ and static loft for embodiments of the disclosed technology. In particular, FIGS. 10 and 11 are graphs having an x-axis showing $CG_z$ values measured in mm from the geometric center of the club head face, where the geometric center is determined in the manner described above. Thus, the value of $CG_z$ measures the distance between the geometric center and the CG along the z-axis originating at the geometric center. FIGS. 10 and 11 also have a y-axis showing static loft values for the club head face, where the values represent the static loft angle (illustrated in FIGS. 1-3 as loft angle 115) measured in degrees. Also shown in FIG. 10 is an area 1002 that represents a range of $CG_z$ and static loft values for golf club heads according to the disclosed technology. Similarly, FIG. 11 includes area 1102 that represents a range of $CG_z$ and static loft values for golf club heads according to the disclosed technology.

Certain embodiments of golf club heads designed in accordance with the disclosed technology have values of $CG_z$ that are less than −7.0 mm. For example, and depending on the overall size of the club head, embodiments of the disclosed technology can have a $CG_z$ value between −7.0 mm and a value representing a z-axis location of the center of gravity just inside the club head body adjacent to its sole. In specific embodiments, and as illustrated by area 1102 in FIG. 11, the $CG_z$ value is between −7.0 mm and −40.0 mm, while in other embodiments illustrated by area 1002 in FIG. 10, the $CG_z$ value is between −7.0 mm and −20.0 mm. Any other range of values between −7.0 mm and a value representing a z-axis location of the center of gravity just inside the club head body adjacent to its sole is also possible and contemplated by this disclosure. For example, certain embodiments of the disclosed technology have a $CG_z$ of between −9.0 mm and −20.0 mm.

Certain embodiments of golf club heads designed in accordance with the disclosed technology also have static loft values that are greater than 11.0°. For example, and as illustrated by area 1102 in FIG. 11, embodiments of the disclosed technology have a static loft of between 11.0° and 33.0°. In specific embodiments, and as illustrated by area 1002 in FIG. 10, the static loft is between 11.0° and 19.0°. Any other range of values between 11.0° and 33.0° is also possible and contemplated by this disclosure. For example, certain embodiments of the disclosed technology have a static loft of between 15.0° and 19.0°. Still other embodiments of golf club heads designed in accordance with the disclosed technology have static loft values between 5.0° and 11.0°.

C. Using Discretionary Mass to Lower the Center of Gravity

Lower center of gravity values can be attained by distributing club head mass to particular locations in the golf club head. Discretionary mass generally refers to the mass of material that can be removed from various structures providing mass and that can be distributed elsewhere for locating the club head center-of-gravity.

Club head walls provide one source of discretionary mass. A reduction in wall thickness reduces the wall mass and provides mass that can be distributed elsewhere. For example, in some implementations, one or more walls of the club head can have a thickness less than approximately 0.7 mm. In some embodiments, the crown 112 can have a thickness of approximately 0.65 mm throughout at least a majority of the crown. In addition, the skirt 116 can have a similar thickness, whereas the sole 114 can have a greater thickness (e.g., more than approximately 1.0 mm). Thin walls, particularly a thin crown 112, provide significant discretionary mass.

To achieve a thin wall on the club head body 110, such as a thin crown 112, a club head body 110 can be formed from an alloy of steel or an alloy of titanium. In other embodiments, the thin walls of the club head body are formed of a non-metallic material, such as a composite material, ceramic material, thermoplastic, or any combination thereof. For example, in particular embodiments, the crown 112 and the skirt 116 are formed of a composite material.

To lower the center of gravity within the club head body 110, one or more portions of the sole 114 can be formed of a higher density material than the crown 112 and the skirt 116. For example, the sole 114 can be formed of metallic material, such as tungsten or a tungsten alloy. The sole 114 can also be shaped so that the center of gravity is closer or further from the golf ball striking club face as desired.

Golf club heads according to the disclosed technology can also use one or more weight plates, weight pads, or weight ports in order to lower the center of gravity to the desired $CG_z$ location. For example, certain embodiments of the disclosed golf club heads have one or more integral weight pads cast into the golf club head at predetermined locations (e.g., in the sole of the golf club head) that lower the club head's center-of-gravity. Also, epoxy can be added to the interior of the club head through the club head's hosel opening to obtain a desired weight distribution. Alternatively, one or more weights formed of high-density materials (e.g., tungsten or tungsten alloy) can be attached to the sole. Such weights can be permanently attached to the club head. Furthermore, the shape of such weights can vary and is not limited to any particular shape. For example, the weights can have a disc, elliptical, cylindrical, or other shape.

The golf club head 100 can also define one or more weight ports formed in the body 110 that are configured to receive one or more weights. For example, one or more weight ports can be disposed in the sole 114. The weight port can have any of a number of various configurations to receive and retain any of a number of weights or weight assemblies, such as described in U.S. Pat. Nos. 7,407,447 and 7,419,441, which are incorporated herein by reference. Inclusion of one or more weights in the weight port(s) provides a customized club head mass distribution with corresponding customized moments of inertia and center-of-gravity locations. Adjusting the location of the weight port(s) and the mass of the weights and/or weight assemblies provides various possible locations of center-of-gravity and various possible mass moments of inertia using the same club head.

In further embodiments, one or more openings in the walls of the golf club head body are formed. For example, the crown of the golf club head can include an opening. A lightweight panel can be positioned within each opening in order to close the opening. By selecting a material for the panels that is less dense than the material used to form the club head body, the difference between the mass of the body material that would otherwise occupy the opening and the panel can be positioned elsewhere in the club head. For example, by strategically selecting the number, size, and location of the openings, the center of gravity of the golf club head can be lowered to a desired position within the club head body. The panels may comprise, for example, carbon fiber epoxy resin, carbon fiber reinforced plastic, polyurethane or quasi-isotropic composites. The panels can be attached using adhesive or any other suitable technique.

In addition to redistributing mass within a particular club head envelope as discussed above, the club head center-of-gravity location can also be tuned by modifying the club head external envelope. For example, the club head body 110 can be extended rearwardly, and its overall height can be reduced. In specific embodiments, for example, the crown of the club head body is indented or otherwise includes an at least partially concave shape, thereby distributing the weight of the crown lower into the club head body.

D. Mass Moments of Inertia

Referring to FIGS. 4-6, golf club head moments of inertia are typically defined about the three CG axes that extend through the golf club head center-of-gravity 150. For example, a moment of inertia about the golf club head CG x-axis 190 can be calculated by the following equation $$I_{xx}=\int(z^2+y^2)dm \quad (1)$$

where y is the distance from a golf club head CG xz-plane to an infinitesimal mass, dm, and z is the distance from a golf club head CG xy-plane to the infinitesimal mass, dm. The golf club head CG xz-plane is a plane defined by the golf club head CG x-axis 190 and the golf club head CG z-axis 185. The CG xy-plane is a plane defined by the golf club head CG x-axis 190 and the golf club head CG y-axis 195.

The moment of inertia about the CG x-axis ($I_{xx}$) is an indication of the ability of the golf club head to resist twisting about the CG x-axis. A higher moment of inertia about the CG x-axis ($I_{xx}$) indicates a higher resistance to the upward and downward twisting of the golf club head 100 resulting from high and low off-center impacts with the golf ball.

In certain embodiments of the disclosed golf club heads, the moment of inertia $I_{xx}$ is at least 250 kg-mm$^2$. For example, in certain embodiments, the moment of inertia $I_{xx}$ is between 250 kg-mm$^2$ and 800 kg-mm$^2$. It has been observed that for embodiments of the disclosed golf club heads in which the projected CG on the club head face is lower than the geometric center, a lower moment of inertia can increase the dynamic loft and decrease the backspin experienced by a golf ball struck at the geometric center of the club. Thus, in particular embodiments, the moment of inertia $I_{xx}$ is relatively low (e.g., between 250 kg-mm$^2$ and 500 kg-mm$^2$). In such embodiments, the relatively low moment of inertia contributes to the reduction in golf ball spin, thereby helping a golf ball obtain the desired high launch, low spin trajectory (e.g., a trajectory similar to that shown in FIG. 9). In still other embodiments, the moment of inertia is less than 250 kg-mm$^2$ (e.g., between 150-250 kg-mm$^2$ or between 200-250 kg-mm$^2$). Adjusting the location of the discretionary mass in a golf club head using the methods described above can provide the desired moment of inertia $I_{xx}$ in embodiments of the disclosed golf club heads.

E. Delta 1

Delta 1 is a measure of how far rearward in the club head body 110 the CG is located. More specifically, Delta 1 is the distance between the CG and the hosel axis along the y axis (in the direction straight toward the back of the body of the golf club face from the geometric center of the striking face). It has been observed that for embodiments of the disclosed golf club heads, smaller values of delta 1 result in lower projected CGs on the club head face. Thus, for embodiments of the disclosed golf club heads in which the projected CG on the ball striking club face is lower than the geometric center, reducing Delta 1 can lower the projected CG and increase the distance between the geometric center and the projected CG. Recall also that a lower projected CG creates a higher dynamic loft and more reduction in backspin due to the z-axis gear effect. Thus, for particular embodiments of the disclosed golf club heads, the Delta 1 values are relatively low, thereby reducing the amount of backspin on the golf ball and helping the golf ball obtain the desired high launch, low spin trajectory (e.g., a trajectory similar to that shown in FIG. 9). For example, in certain embodiments, the Delta 1 values are 25 mm or lower (e.g., in the range of 10-25 mm). Adjusting the location of the discretionary mass in a golf club head as described above can provide the desired Delta 1 value. For instance, Delta 1 can be manipulated by varying the mass in front of the CG (closer to the face) with respect to the mass behind the CG. That is, by increasing the mass behind the CG with respect to the mass in front of the CG, Delta 1 can be increased. In a similar manner, by increasing the mass in front of the CG with the respect to the mass behind the CG, Delta 1 can be decreased.

F. Bulge and Roll

Bulge and roll are golf club face properties that are generally used to compensate for gear effect. The term "bulge" on a golf club refers to the rounded properties of the golf club face from the heel to the toe of the club face. The term "roll" on a golf club refers to the rounded properties of the golf club face from the crown to the sole of the club face. In certain embodiments of the disclosed technology, the "roll" or "roll radius" of the golf club head is designed to improve the trajectory of a golf ball when stricken at the geometric center of the club, which in certain embodiments of the disclosed technology is off-center of the projected CG on the ball striking club face. The roll radius R refers to the radius of a circle having an arc that corresponds to the arc along the z-axis of the ball striking club face. Curvature is the inverse of radius and is defined as 1/R, where R is the radius of the circle having an arc corresponding to the arc along the z-axis of the ball striking club face. As an example, a roll with a curvature of 0.0050 mm$^{-1}$ corresponds to a roll with a radius of 200 mm.

The roll of the golf club head can contribute to the amount of backspin that the golf ball acquires when it is struck by the club head at a point on the club face either above or below the projected CG of the club head. For example, shots struck at a point on the club face above the projected CG (e.g., at the geometric center 123 above the projected CG 180 in FIG. 7) have less backspin than shots struck at or below the projected CG. If the roll radius of the club head is decreased, there will be a decreased variance between backspin for shots struck above the projected CG of the golf club face and shots struck below the projected CG of the ball striking club face.

In certain embodiments of the disclosed golf club heads, the roll radius is relatively large (e.g., greater than or equal to 300 mm). Thus, for embodiments of the disclosed golf club heads in which the projected CG on the ball striking club face is lower than the geometric center, the higher roll radius operates to enhance the z-axis gear effect when a ball is stricken at the geometric center, thereby reducing the amount of backspin on the golf ball and helping the golf ball obtain the desired high launch, low spin trajectory (e.g., a trajectory similar to that shown in FIG. 9). Furthermore, in certain implementations of the disclosed golf club heads, the golf club face is flat or concave in order to further reduce the backspin imparted on a golf ball having a relatively high static loft. In other embodiments, the roll radius is less than 300 mm. In certain embodiments, for example, the roll radius is between about 100 and 150 mm.

G. Volume

Embodiments of the disclosed golf club heads disclosed herein can have a variety of different volumes. For example, certain embodiments of the disclosed golf club heads are for drivers and have a head volume of between 250 and 460 cm$^3$ and a weight of between 180 and 210 grams. Other embodiments of the disclosed golf club heads have a volume larger than 460 cm$^3$. If such a club head is desired, it can be constructed as described above by enlarging the size of the strike plate and the outer shell of the golf club head. Furthermore, such "large" club heads allow for greater opportunity to achieve a lower $CG_z$ in the golf club head. It should also be understood that golf club heads that have volumes or dimensions in excess of the current U.S.G.A. rules on clubs and ball are possible and contemplated by this disclosure.

H. Exemplary Embodiments

Figure 14A:
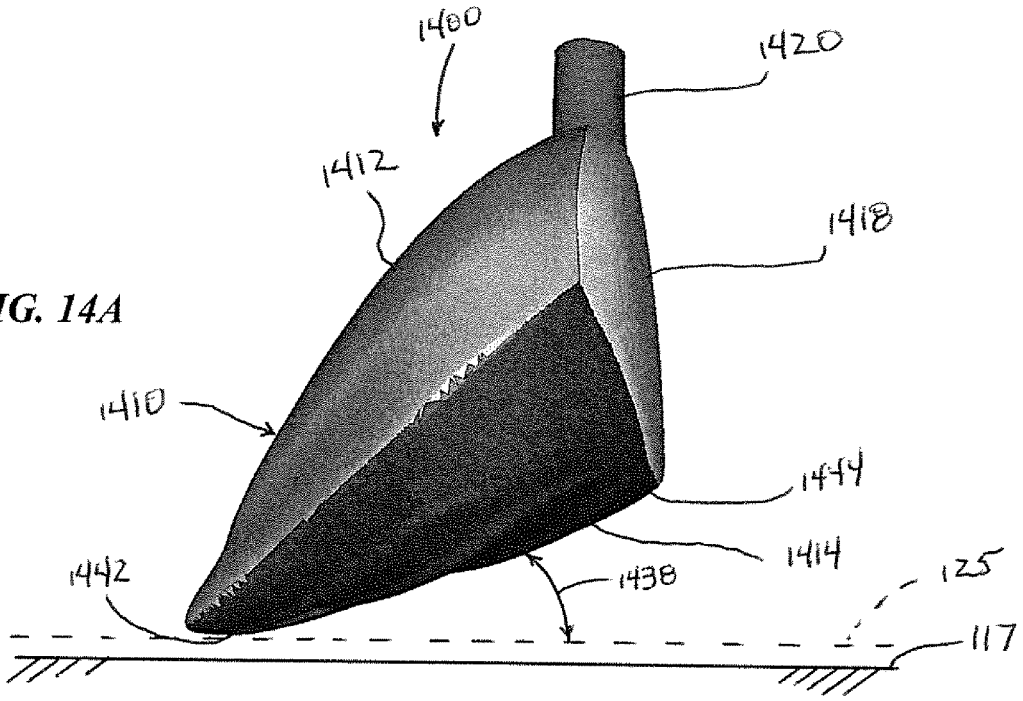
FIG. 14A is a side elevation view from a toe side of an exemplary embodiment of a golf club head.
Figure 14B:
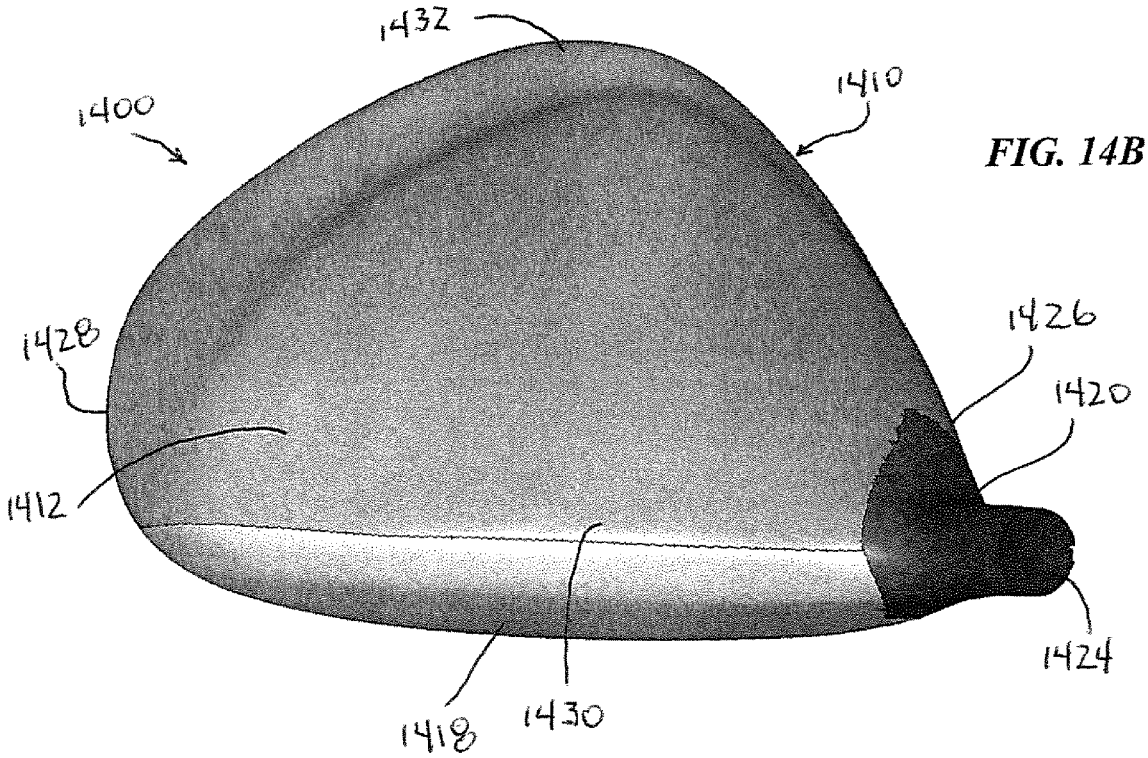
FIG. 14B is a top plan view of the golf club head of FIG. 14A.
Figure 14C:
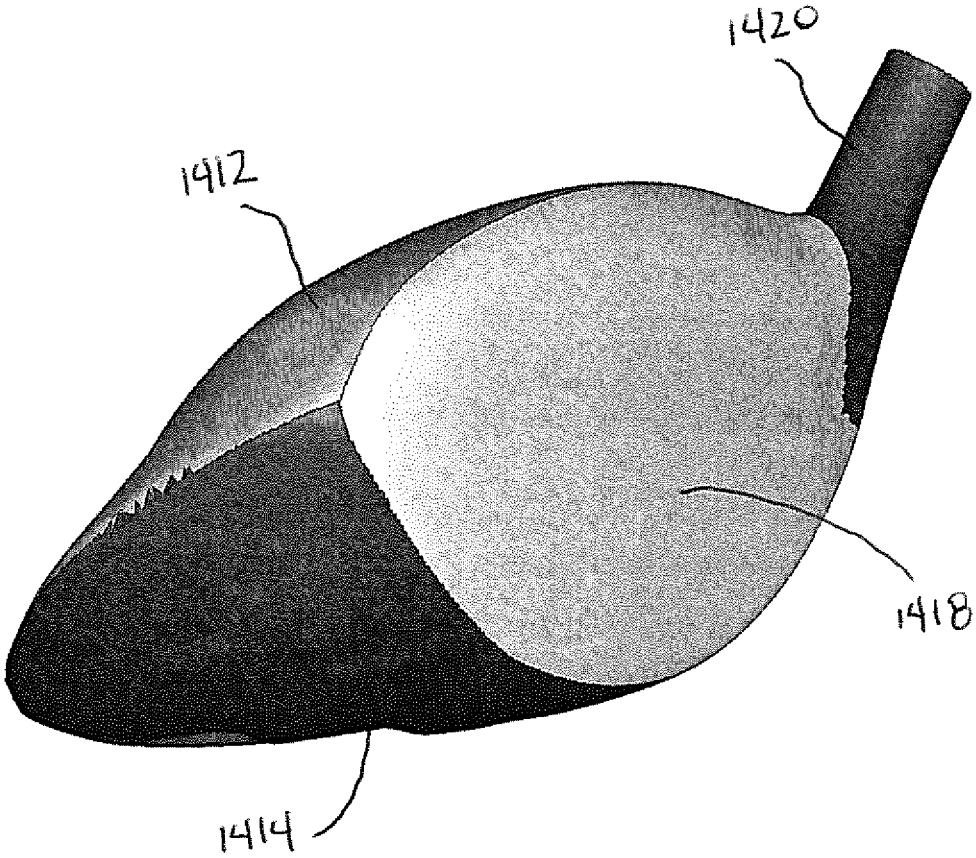
FIG. 14C is a perspective view from a front and toe side of the golf club head of FIG. 14A.

FIGS. 14A-C illustrates an embodiment of a golf club head having a relatively high static loft and relatively low center of gravity. FIG. 14A illustrates a toe side elevation view of the golf club head 1400, FIG. 14B illustrates a top plan view of the golf club head 1400, and FIG. 14C illustrates a front and toe side perspective view of the golf club head 1400. As discussed above in relation to the golf club head embodiments shown in FIGS. 1-3, the golf club head 1400 includes a hollow body 1410 defining a crown portion 1412, a sole portion 1414, and a ball striking club face 1418. The ball striking club face 1418 can be integrally formed with the body 1410 or attached to the body. The body 1410 further includes a hosel 1420, which defines a hosel bore 1424 adapted to receive a golf club shaft. The body 1410 further includes a heel portion 1426, a toe portion 1428, a front portion 1430, and a rear portion 1432.

At normal address position, the club head 1400 is positioned on a plane 125 above and parallel to a ground plane 117. As shown in particular in FIG. 14A, at the normal address position, the sole portion 1414 of the embodiment shown is inclined at a sole angle 1438 relative to the plane 125 such that a rear portion 1442 of the sole is positioned lower than a front portion 1444 of the sole. In some embodiments, the sole angle 1438 is between about 5° to about 40°, such as from about 7° to about 30°, such as from about 10° to about 25°, or from about 15° to about 22°.

A three-dimensional model of the golf club head 1400 of the embodiment shown in FIGS. 14A-C was created and subdivided into sections corresponding to the crown portion 1412, the sole portion 1414, the ball striking clubface 1418, and the hosel 1420. Each section was then constructed in the model to have the materials, thicknesses, and other properties listed in Table 1 below:

TABLE 1

| | Example 1 | Example 2 | Example 3 | Example 4 | Example 5 |
|---|---|---|---|---|---|
| Mass | 199.7 g | 200.8 g | 200.4 g | 201.4 g | 200.3 g |
| CGx | 1.3 mm | 0.9 mm | 1.2 mm | 1.0 mm | 0.7 mm |
| Delta 1 | 14.4 mm | 12.7 mm | 14.2 mm | 18.1 mm | 16.3 mm |
| CGz | −10.4 mm | −14.9 mm | −11.1 mm | −15.3 mm | −19.6 mm |
| Face Thk | 2.5 mm | 2.5 mm | 2.5 mm | 5.0 mm | 5.0 mm |
| Face Mtl | Ti alloy | Ti alloy | Ti alloy | Composite | Composite |
| Crown Thk | 1.0 mm | 1.5 mm | 1.5 mm | 1.0 mm | 1.5 mm |
| Crown Mtl | Ti alloy | Composite | Al alloy | Ti alloy | Composite |
| Hosel Thk | 1.0 mm | 1.0 mm | 1.0 mm | 1.0 mm | 1.0 mm |
| Hosel Mtl | Ti alloy | Ti alloy | Ti alloy | Ti alloy | Ti alloy |
| Sole Thk | 1.45 mm | 2.1 mm | 1.55 mm | 2.0 mm | 2.6 mm |
| Sole Mtl | Ti alloy | Ti alloy | Ti alloy | Ti alloy | Ti alloy |

In Table 1, the materials listed include Titanium alloy ("Ti alloy") having a density of approximately 4.5 g/cc$^3$, a carbon fiber epoxy composite ("Composite") having a density of approximately 1.5 g/cc$^3$, and an aluminum alloy ("Al alloy") having a density of approximately 2.8 g/cc$^3$. As noted in the Table, the foregoing exemplary embodiments included designs having values for CGz ranging from about −10.4 mm to about −19.6 mm.

I. Concluding Remarks

Having illustrated and described the principles of the illustrated embodiments, it will be apparent to those skilled in the art that the embodiments can be modified in arrangement and detail without departing from such principles. For example, although the embodiments disclosed above are made primarily with reference to drivers and driving-wood-type clubs, any aspect of the disclosed technology can be incorporated into a fairway wood having a smaller volume and/or greater mass. For example, a fairway wood or rescue wood having any of the disclosed low CG and/or static high loft characteristics are considered to be within the scope of this disclosure. For instance, embodiments of fairway woods incorporating any one or more aspects of the disclosed technology have a volume between about 130 and 220 cm$^3$ and a weight of between about 190 and 225 grams, whereas embodiments of rescue woods incorporating any one or more aspects of the disclosed technology have a volume between about 80 and 150 cm$^3$ and a weight of between about 210 and 240 grams.

In view of the many possible embodiments to which the principles of the disclosed invention(s) may be applied, it should be recognized that the illustrated embodiments are only preferred examples and should not be taken as limiting the scope of the disclosure. Rather, the scope of the disclosure is at least as broad as the following claims and their equivalents. We therefore claim all that comes within the scope and spirit of these claims and their equivalents.

The invention claimed is:

1. A golf club head, comprising:

a club head body having an external surface with a heel portion, a toe portion, a crown portion, a sole portion, a skirt portion positioned around a periphery between the sole portion and crown portion, a ball striking face having a thickness, and a hosel integrally formed with the club head body and extending outward from the club head body proximate to a crown and heel transition region;

wherein the ball striking face of the club head body has a geometric center;

wherein the crown portion has one or more openings, and wherein one or more corresponding crown panels are placed in the one or more openings, the crown panels having a first material density and a first portion thickness;

wherein a portion of the club head body located below a geometric center of the ball striking face is formed of a second material having a second material density and a second portion thickness, wherein the second material density is at least twice the first material density of the crown panels;

wherein at least a portion of the ball striking face is formed of a composite material;

wherein a moment of inertia about the golf club head center-of-gravity x-axis, $I_{xx}$, is between 250-800 kg-mm$^2$;

wherein the golf club head has a Delta 1 between 10 to 25 mm;

where the golf club head has a club head volume of at least 250 cm$^3$ and a club head weight of between about 190 and 210 grams; and wherein the golf club head has a center of gravity that is below the geometric center of the ball striking face of the golf club head as measured along a z-axis of the golf club head having an origin at the geometric center.

2. The golf club head of claim 1, wherein the center of gravity of the golf club head is 5-20 mm below the geometric center of the ball striking face of the golf club head as measured along a z-axis of the golf club head having an origin at the geometric center; and wherein the ball striking face has a varying thickness of no greater than 5 mm.

3. The golf club head of claim 2, wherein a projection of the center of gravity onto the ball striking face of the club head body is located off-center from the geometric center in a direction toward the sole portion.

4. The golf club head of claim 1, wherein the sole portion is at least partially formed of a material that is denser than the material used to form the crown portion.

5. The golf club head of claim 4, wherein the one or more crown panels are formed of a composite material.

6. The golf club head of claim 5, wherein the ball striking face having a varying thickness of no less than 2.5 mm.

7. The golf club head of claim 6, wherein the ball striking face having a varying thickness of no greater than 5 mm.

8. The golf club head of claim 1, wherein the first material density has a density of approximately 2.8 g/cc or less.

9. The golf club head of claim 1, wherein the first material density and the at least a portion of the ball striking face formed of composite material have a density of approximately 1.5 g/cc.

10. The golf club head of claim 1, wherein the second material is formed of a titanium alloy.

11. The golf club head of claim 1, wherein the second material is formed of a steel alloy.

12. The golf club head of claim 1, wherein the club head body is formed from a combination of an alloy of titanium, an alloy of aluminum, and a composite material.

13. The golf club head of claim 12, wherein the crown panels, the skirt, and the ball striking face are held in place by adhesive bonding.

14. The golf club head of claim 1, wherein the crown panels, the skirt, and the ball striking face are held in place by adhesive bonding.

15. A golf club head, comprising:

a club head body having an external surface with a heel portion, a toe portion, a crown portion, a sole portion, a skirt portion positioned around a periphery between the sole portion and crown portion, a ball striking face having a thickness, and a hosel integrally formed with the club head body and extending outward from the club head body proximate to a crown and heel transition region;

wherein the ball striking face of the club head body has a geometric center;

wherein the crown portion has one or more openings, and wherein one or more corresponding crown panels are placed in the one or more openings, the crown panels having a first material density and a first portion thickness;

wherein a portion of the club head body located below a geometric center of the ball striking face is formed of a second material having a second material density and a second portion thickness, wherein the second material density is at least twice the first material density of the crown panels;

wherein a moment of inertia about a golf club head center-of-gravity x-axis, $I_{xx}$, is between 250-800 kg-mm$^2$;

wherein the golf club head has a Delta 1 between 10 to 25 mm;

where the golf club head has a club head volume of at least 250 cm$^3$ and a club head weight of between about 190 and 210 grams;

wherein the club head body is formed from a combination of an alloy of titanium, an alloy of aluminum, and a composite material;

wherein the crown panels and the skirt are held in place by adhesive bonding;

wherein the ball striking face having a varying thickness no more 5 mm;

wherein the ball striking face having a roll radius of 300 mm or greater; and wherein the golf club head has a center of gravity that is below the geometric center of the ball striking face of the golf club head as measured along a z-axis of the golf club head having an origin at the geometric center.

16. The golf club head of claim 15, wherein the club head volume is at least 460 cm$^3$ or greater.

17. The golf club head of claim 16, wherein at least a portion of the ball striking face is formed of a composite material.

18. The golf club head of claim 15, wherein the center of gravity is 5-20 mm below the geometric center of the ball striking face of the golf club head as measured along a z-axis of the golf club head having an origin at the geometric center.

19. The golf club head of claim 15, wherein a projection of the center of gravity onto the ball striking face of the club head body is located off-center from the geometric center in a direction toward the sole portion.

20. The golf club head of claim 15, wherein the sole portion is at least partially formed of a material that is denser than the material used to form the crown portion.

* * * * *